US008608395B2

(12) United States Patent
Bober et al.

(10) Patent No.: US 8,608,395 B2
(45) Date of Patent: Dec. 17, 2013

(54) FLOOR FINISH APPLICATOR

(75) Inventors: Andrew M. Bober, Racine, WI (US); Charles A. Crawford, Racine, WI (US); Lance D. Brown, Racine, WI (US); Douglas S. Rodenkirch, Sun Prairie, WI (US); Scott I. Biba, Highland, WI (US); Craig P. Conner, Madison, WI (US); Daniel R. Nett, Sun Prairie, WI (US); Nicholas S. Reback, Monona, WI (US)

(73) Assignee: Diversey, Inc., Sturtevant, WI (US)

( * ) Notice: Subject to any disclaimer, the term of this patent is extended or adjusted under 35 U.S.C. 154(b) by 0 days.

(21) Appl. No.: 13/590,595

(22) Filed: Aug. 21, 2012

(65) Prior Publication Data

US 2012/0315075 A1 Dec. 13, 2012

Related U.S. Application Data

(63) Continuation of application No. 11/780,705, filed on Jul. 20, 2007, now Pat. No. 8,246,263.

(51) Int. Cl.
*A46B 11/00* (2006.01)

(52) U.S. Cl.
USPC ..... 401/48; 401/139; 401/268; 401/292

(58) Field of Classification Search
USPC ..... 401/48, 137, 139, 268, 292; 239/146, 239/155, 157, 99, 100; 118/207, 264, 266, 118/305; 15/98; 417/477.1, 477.13
See application file for complete search history.

(56) References Cited

U.S. PATENT DOCUMENTS

| | | | |
|---|---|---|---|
| 1,516,734 | A | 11/1924 | Johnson |
| 1,538,226 | A | 5/1925 | Straehle et al. |
| 1,786,067 | A | 12/1930 | Horste |
| 2,104,387 | A | 1/1938 | Hull et al. |
| 2,737,340 | A | 3/1956 | Bonini |

(Continued)

FOREIGN PATENT DOCUMENTS

| | | |
|---|---|---|
| JP | 63071101 | 3/1988 |
| JP | 4-106673 | 9/1992 |

(Continued)

OTHER PUBLICATIONS

Fas-Trak Ind., "Ultra-Trak Model 5000," owners manual, (2005) pp. 1-10, PIB 6504 Rev J EC05-028, www.fas-trakind.com.

(Continued)

*Primary Examiner* — Steven J Ganey
(74) *Attorney, Agent, or Firm* — Michael Best & Friedrich LLP

(57) ABSTRACT

A pull-behind floor finish applicator wherein a peristaltic pump is employed in conjunction with disposable conduit tubing obviate any clean up of the pump. This applicator is adaptable to receiving bag in the box floor finish, thus reducing cleaning time. The applicator employs a minimum number of disposable parts thus making it economical to produce. A mop is employed to apply floor finish to easily accessible areas in one instance, yet allows the mop to be used independently for application of floor finish to not so easily accessible areas.

19 Claims, 5 Drawing Sheets

(56) References Cited

U.S. PATENT DOCUMENTS

| | | | | |
|---|---|---|---|---|
| 2,979,756 | A | 4/1961 | Wallis | |
| 3,174,604 | A | 3/1965 | Lambie | |
| 3,457,015 | A | 7/1969 | Taber | |
| 3,470,767 | A | 10/1969 | Gray | |
| 3,981,596 | A | 9/1976 | Melton | |
| 4,124,315 | A | 11/1978 | Melton | |
| 4,296,875 | A | 10/1981 | Borglum | |
| 4,471,713 | A | 9/1984 | Cote et al. | |
| 4,475,872 | A | 10/1984 | Foughty | |
| 4,588,318 | A | 5/1986 | O'Brien et al. | |
| 5,433,380 | A | 7/1995 | Hahn | |
| 6,017,163 | A | 1/2000 | Keppers et al. | |
| 6,266,838 | B1 | 7/2001 | Caruso | |
| 6,378,162 | B1 | 4/2002 | Zahuranec et al. | |
| 6,524,386 | B1 | 2/2003 | Slager, Sr. | |
| 6,827,237 | B2 | 12/2004 | Yorn et al. | |
| 6,854,912 | B2 | 2/2005 | Dyer et al. | |
| 6,875,497 | B2 | 4/2005 | Emery et al. | |
| 7,137,170 | B1 | 11/2006 | Morey et al. | |
| 7,160,044 | B2 | 1/2007 | Dyer et al. | |
| 7,850,383 | B2 | 12/2010 | Bober et al. | |
| 8,366,336 | B2 | 2/2013 | Bober et al. | |
| 2008/0104783 | A1 * | 5/2008 | Crawford et al. | 15/98 |

FOREIGN PATENT DOCUMENTS

| | | |
|---|---|---|
| JP | 0570451 | 9/1993 |
| JP | 11155789 | 6/1999 |
| JP | 11267080 | 10/1999 |
| JP | 2006212279 | 8/2006 |
| WO | 03/106042 | 12/2003 |

OTHER PUBLICATIONS

Kaivac, Inc., "KiaMotion, Kaivac Cleaning Systems," advertisement (2005) 2 pages, http://www.kaivac.com/kaimotion.asp, Hamilton.

Kaivac, Inc., "KiaMotion II, Kaivac Cleaning Systems," advertisement (2005) 2 pages, http://www.kaivac.com/kaimotionll.asp, Hamilton.

Kaivac, Inc., "KiaMotion, SUV Kaivac Cleaning Systems," advertisement (2006) 1 page, http://www.kaivac.com/kaimotionsuv.asp, Hamilton.

Hillyard, Inc., "Multi-Flo, the Cleaning Resource," advertisement (2006) 1 page, http://www.hillyard.com/.

Hillyard, Inc., "Multi-Flo, Automated Applicator, 10,000 Square Feet Per Hour," advertisement (undated, admitted prior art) 1 page, http://www.hillyard.com/, St. Joseph.

* cited by examiner

FLOOR FINISH APPLICATOR

CROSS REFERENCE TO RELATED APPLICATION

This application is a continuation of U.S. patent application Ser. No. 11/780,705, filed Jul. 20, 2007 and published as U.S. Publication No. 2009/0022540. The entire contents of the application and publication identified above are hereby incorporated by reference.

FIELD OF THE INVENTION

The present invention relates to applicators for floor finish. More particularly, it relates to a simplified pull-behind floor finish applicator which utilizes a pump and a detachable mop as a component of a pull-behind cart.

BACKGROUND

Pull-behind floor finish applicators are disclosed in U.S. Pat. Nos. 2,979,756; 3,457,015; 3,981,596; 4,124,315; and 4,471,713. Other floor finish applicators of this type are available from Fast-Trak Inc. as Ultra-Trak floor finish applicator and Hillyard, Inc. of St. Joseph, Mo. as Multi-Flo applicator.

These applicators involve mechanisms which have numerous components C and/or do not provide for a separate mopping function. For example, the applicators described in U.S. Pat. Nos. 2,979,756 and 3,981,596 include pressurized tanks with complex delivery systems. These involve time consuming cleaning operations. Those described in U.S. Pat. Nos. 3,457,015 and 4,124,315 do not provide for a separate mopping function. U.S. Pat. No. 4,471,713 provides a piston pump for delivering floor finish to a mop. However, the piston pump presents cleaning problems.

A pull-behind floor finish applicator should be simple in its construction so as to be economical to produce. It should also be capable of applying floor finish in those places where the application cannot readily be achieved. It should also provide for easy cleaning The prior art does not provide a floor finish applicator which has a minimum number of parts, yet can apply floor finish in floor areas which are both readily accessible by a mobile machine and those which are not. Neither does the prior art provide a floor finish applicator of the foregoing type which is easily operated and cleaned.

SUMMARY

One aspect of the present invention provides a pull-behind floor finish applicator which includes a wheeled cart including a body member constructed and arranged to receive a source of floor finish. The wheeled cart includes a wheel driven axle. A floor finish spreading mop having a handle member and a floor finish spreading member is coupled to the cart. A peristaltic pump is connected to the body member and a conduit is connectable to the source of floor finish and the pump. A transmission assembly is constructed and arranged to drive the pump by movement of the wheels.

In one embodiment, the transmission assembly includes a spring loaded clutch actuator with the spring loaded clutch actuator including at least one thrust washer and a pivotal bar member for engaging the thrust washer.

In one embodiment, the transmission assembly includes a drive gear connected to the wheel driven axle and a drive shaft with a bevel gear for engaging the drive gear and driving the pump.

In one aspect the drive gear includes a one-way roller clutch.

In still another embodiment, the drive shaft includes a first shaft with the bevel gear and a second shaft, the shafts interconnected by a pin and slot arrangement.

In still a further embodiment, the wheeled cart includes a means for detaching the handle from the cart for use in area where the cart cannot conveniently or easily fit.

In another aspect, the control means includes a lever attached to the drive shaft, a cable attached to the drive shaft and handle member to actuate the cable.

In still anther aspect, the peristaltic pump is housed in a compartment of the body member and accessible from outside the body member.

In yet another aspect, the source of the floor finish is a bag-in-box.

Some embodiments are directed toward a floor finish applicator comprising a wheeled cart including a body member constructed and arranged to receive a source of floor finish; a floor finish spreading mop coupled to the cart; a peristaltic pump connected to the body member, the peristaltic pump including a first conduit substantially contained within the pump; and a second conduit connectable between a source of floor finish and the pump; wherein the first and second conduits are easily separable from the cart during cleaning operations of the cart.

Some embodiments are directed toward a method of cleaning a floor finish applicator including a wheeled cart, a floor finish spreading mop and peristaltic pump coupled to the cart, wherein the peristaltic pump includes a first conduit substantially contained within the pump and applicator includes a second conduit connectable between a source of floor finish supported on the cart and the pump, the method comprising removing the first conduit from the peristaltic pump; and separating the second conduit from the peristaltic pump.

Another embodiment provides a floor finish applicator includes a cart having wheels and a body member constructed and arranged to receive a source of floor finish, a mop having a handle member and a mop head, a clamp assembly disposed at a first end of the body member, and configured to detachably mount the mop to the cart, and a handle disposed at an opposite end of the body member.

Another embodiment of the invention provides a floor finish applicator including a wheeled cart having a body member having a first end and a second end and constructed and arranged to receive a source of floor finish, a clamp assembly disposed adjacent the first end and configured to removably secure a handle member of a mop to the cart, a handle disposed adjacent the second end, The clamp assembly includes a first clamp member and a second clamp member offset from the first clamp member to secure the handle member at an angle relative to a floor surface.

Another embodiment of the invention provides a floor finish applicator including a wheeled cart having a body member constructed and arranged to receive a source of floor finish, a clamp assembly configured to detachably secure a handle member of a mop, a peristaltic pump connected to the body member, a conduit adapted to be connected to the source of floor finish and the pump, and a transmission assembly constructed and arranged to drive the pump by movement of the wheels.

One object of the invention is to provide a floor finish applicator of the foregoing type which allows large areas of a floor to be coated quickly and efficiently.

Still another object of the invention is to provide a floor finish applicator of the foregoing type which is easily operated.

Yet another object is to provide a floor finish applicator of the foregoing type which is easily maintained.

Still yet another object is to provide a floor finish applicator of the foregoing type which affords easy clean up.

Other aspects of the invention will become apparent by consideration of the detailed description and accompanying drawings.

DETAILED DESCRIPTION

Figure 1:
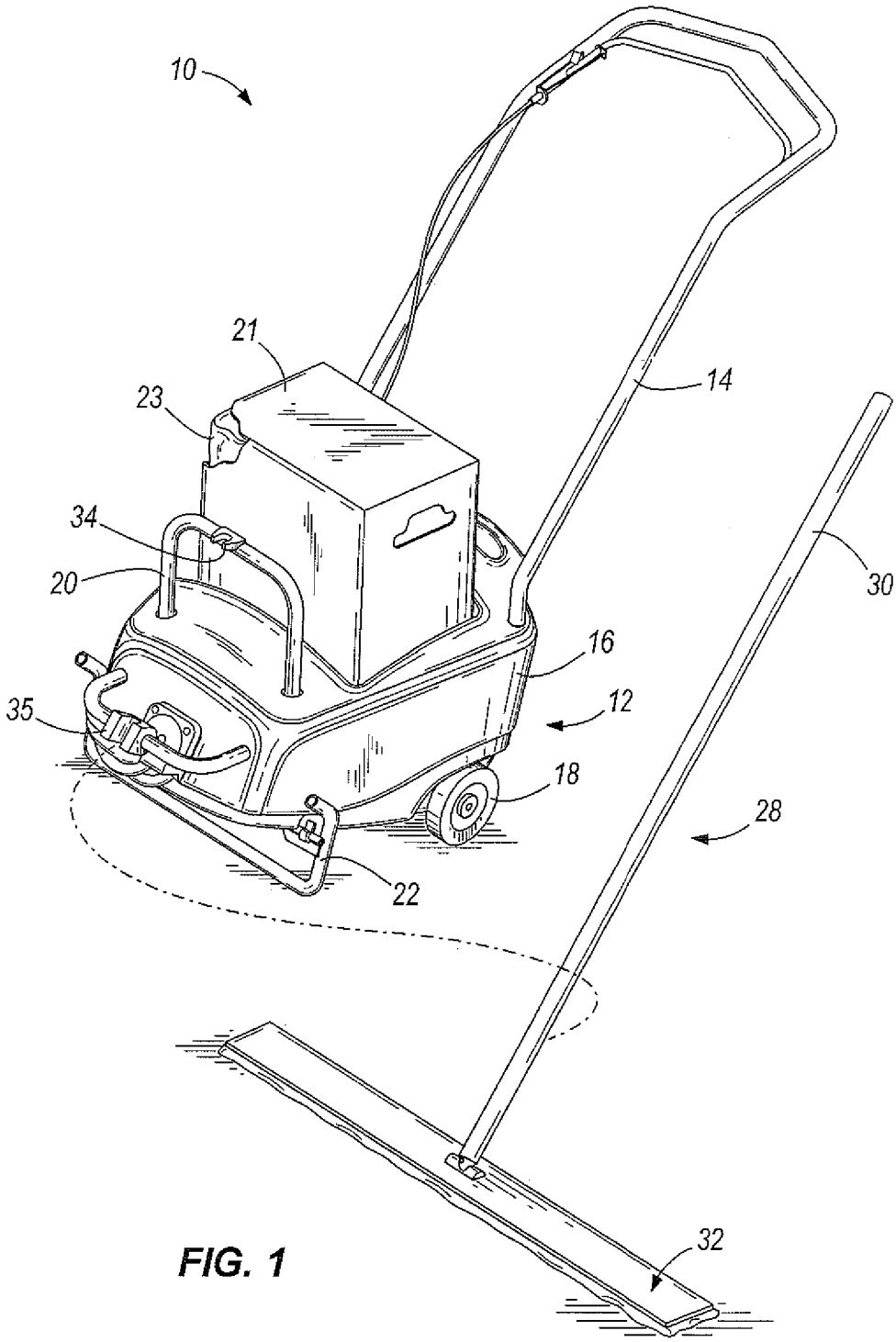
FIG. 1 is a perspective view of the floor finish applicator embodying aspects of this invention, showing a mop disconnected from the applicator.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

As shown in FIGS. 1-8, the floor finish applicator generally 10 includes a cart 12 with a U-shaped tubular handle member 14 joined to a molded plastic base portion 16 with wheels 18 rotatably mounted thereon. A box 21 with a bag 23 containing floor finish is supported in housing 16 which provides a carrier member for the box 21. A kickstand 22 supports base portion 16 of cart 12. A spring 60 pivotally biases kickstand 22 toward the housing 16.

Connected to the housing 16 is a frame member 20 with clamps 34 and 35. A mop 28 having a handle 30 and a mop head 32 is removably attached to the frame member 20 by the clamps 34 and 35. In a preferred manner, mop head 32 has a pad comprised of materials of different sizes for purpose of spreading and leveling the floor finish. It can be made of foam, flocked foam, woven or non-woven cloth.

Figures 2, 3:
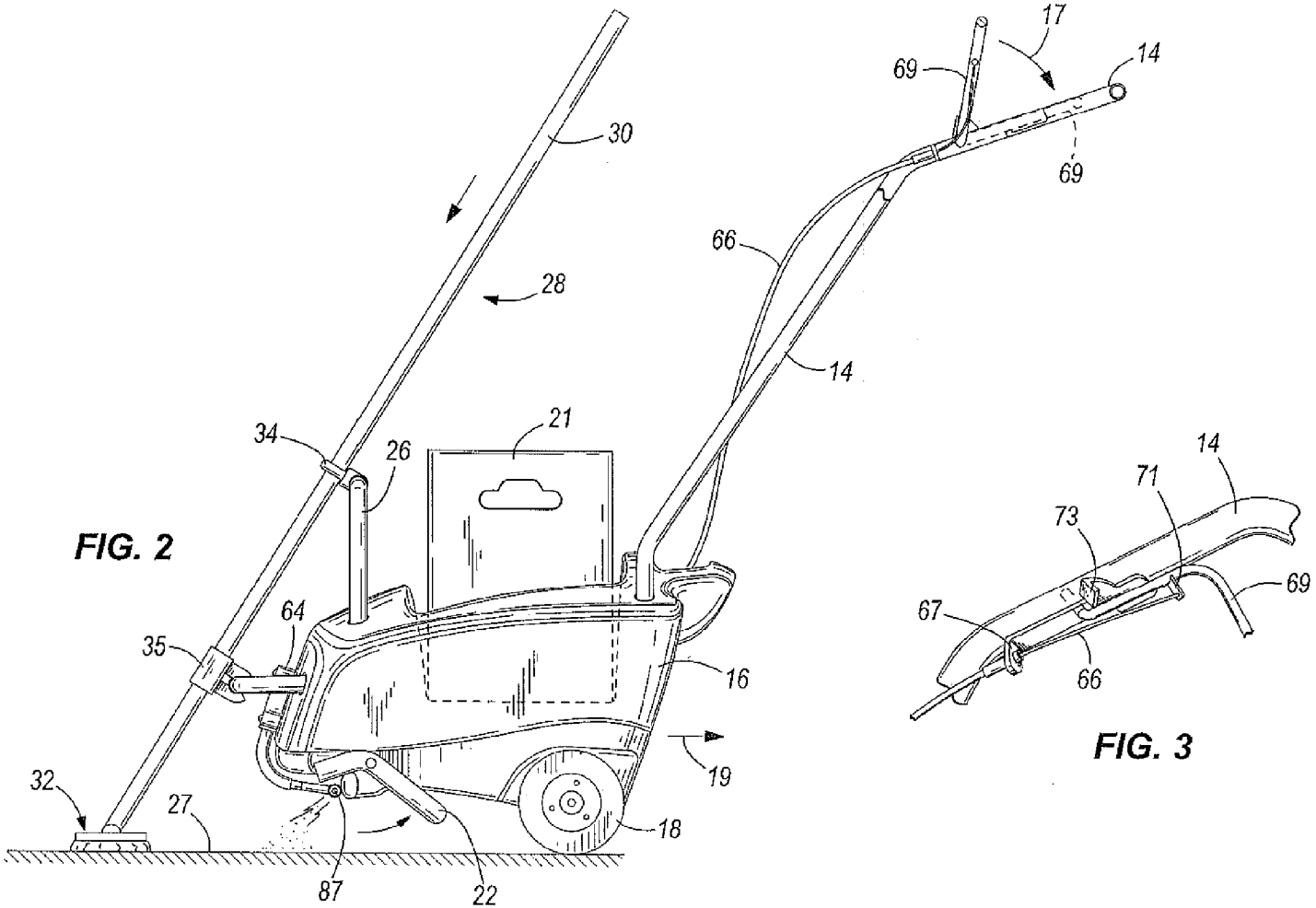
FIG. 2 is a side view of the applicator illustrated in FIG. 1 with the mop attached and illustrating the actuation of a bail.
FIG. 3 is a detailed view of the stop mechanism for the bail illustrated in FIG. 2.
Figure 4:
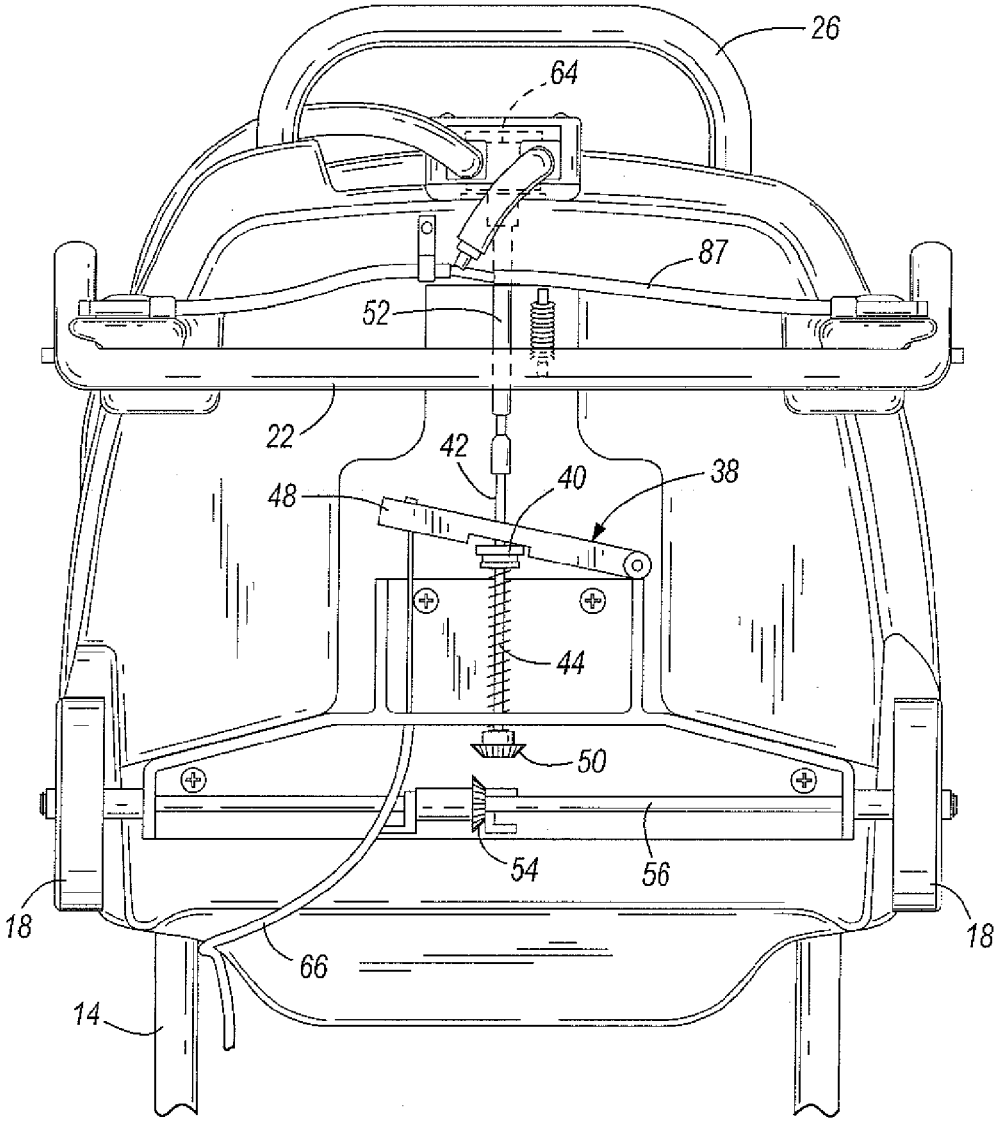
FIG. 4 is a bottom view of the applicator shown in FIG. 1 illustrating the drive means for activating a pump, the drive means in a deactivated position.
Figure 6:
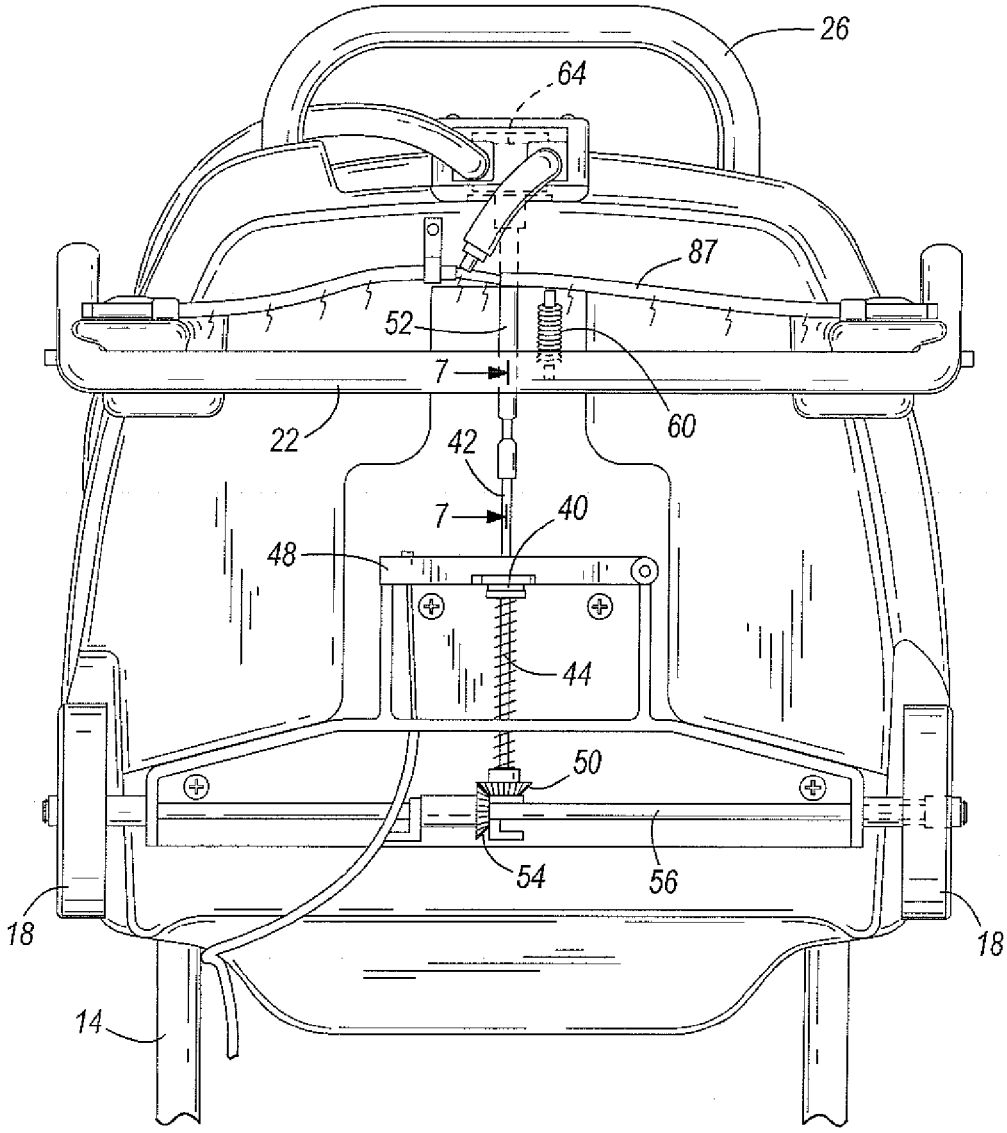
FIG. 6 is a view similar to FIG. 4 showing the drive means in an activated position.
Figure 7:
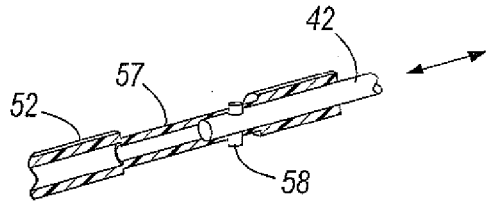
FIG. 7 is a sectional view taken along line 7-7 of FIG. 6.

Referring to FIGS. 3, 6 & 7 a transmission assembly for transmitting power from the wheels to the pump 64 is shown. The transmission assembly includes a spring loaded clutch 38 for selectively controlling actuation of the pump 64. The clutch includes a thrust washer 40 slideably received on drive shaft 42. A spring 44 biases washer 40 against pivotal bar 48. Cable 66 is attached to pivotal bar 48. A bevel gear 50 is connected to drive shaft 42. The opposing end of drive shaft 42 is slideably received in drive shaft 52 which connects to pump 64. A drive gear 54 is mounted on axle 56.

Figure 5:
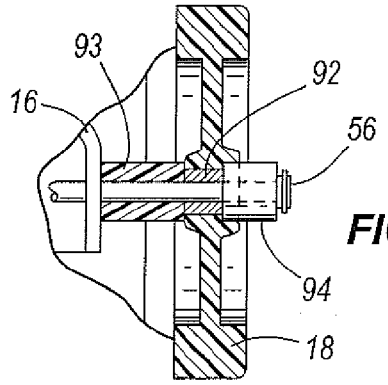
FIG. 5 is a detailed view of FIG. 4 in cross-section showing a roller clutch in conjunction with a wheel.

As seen in FIGS. 2 and 5, cable 66 is also attached to bail 69 by the connecting peg 71 and is slideably secured in bracket 67 dispensed on handle 14. Bail 69 is pivotally attached to handle 14. There is also a bail stop 73 connected to handle 14.

The pump 64 can include a variety of different pumps, such as piston pump, gear pump, diaphragm pump, peristaltic pump, and the like. While each pump can be utilized to deliver floor finish and can be operable via the transmission assembly described above, the peristaltic pump embodiment is a highly preferred embodiment. As explained in greater detail below, the peristaltic pump is preferred because it is substantially easier to clean since the floor finish does not contact the pump.

Figure 8:
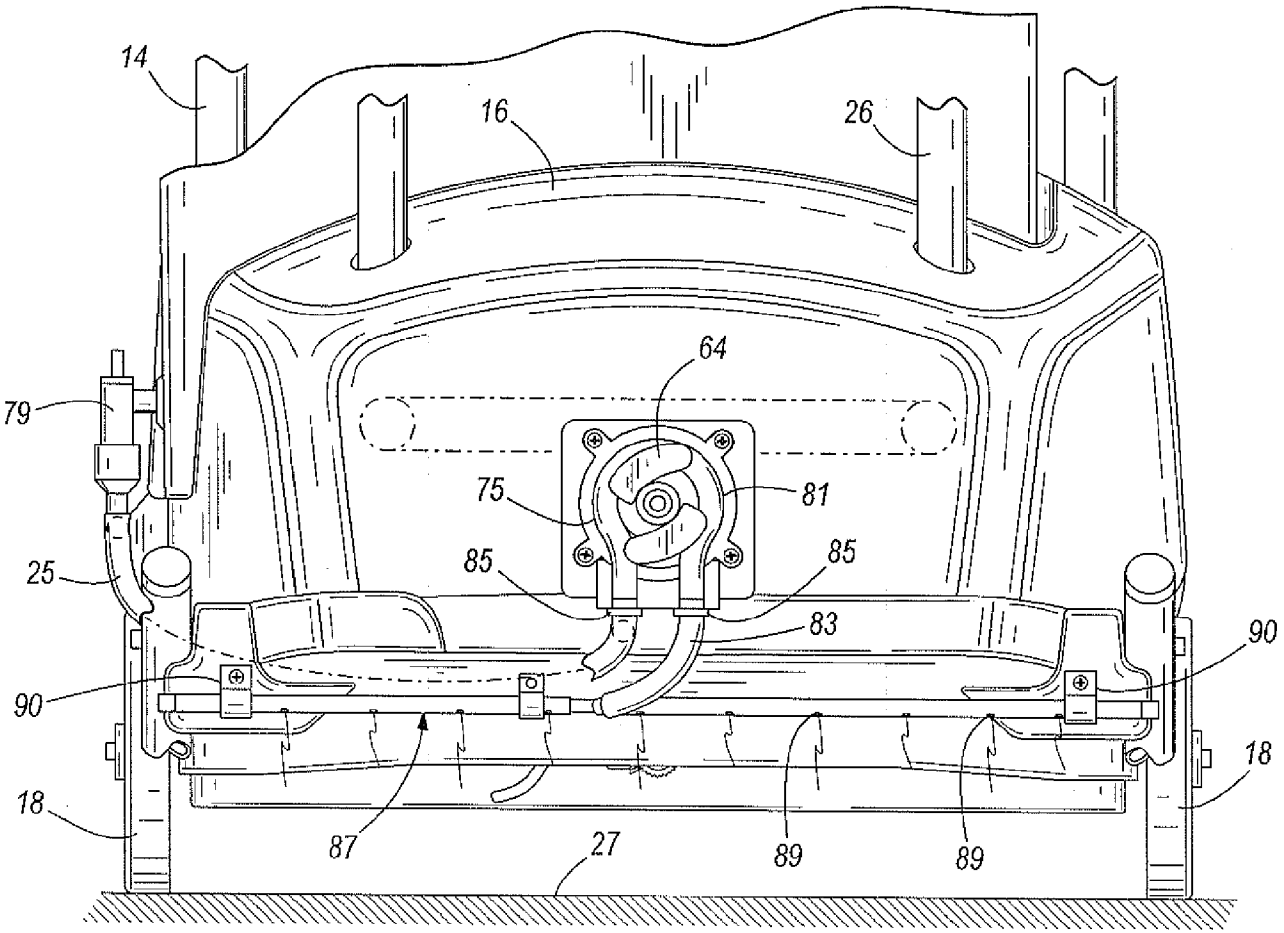
FIG. 8 is a front view of the applicator illustrated in FIG. 1 showing the pump and illustrating the dispensing of floor finish.

Referring to FIG. 8, the peristaltic pump is housed in compartment 75. A floor finish feed conduit 25 is in fluid communication with the bag 23 by means of the connector 79. Feed conduit 25 is also in fluid communications with pump conduit 81 and is output conduit 83. Sleeves 85 provide connection between conduits 25, 83 and pump conduit 81. A spray conduit 87 with orifices 89 is attached to housing 16 by the brackets 90.

A further understanding of the floor finish applicator 10 can be had by a description of its operation as seen in FIGS. 1-8. The bag 23 containing floor finish in placed in box 21 and the box loaded into the housing 16 of cart 12 as illustrated in FIG. 1. Bag 23 is connected to flexible feed tube 25 as indicated in FIG. 8. Mop 28 is clamped to the applicator 10 by means of clamps 28 and 29, as shown in FIG. 2. When it is desired to dispense floor finish from bag 23 onto the floor surface 27, the applicator 10 is moved in a direction indicated by the directional arrow 19 shown in FIG. 2. Bail 69 is then moved in the direction shown by the directional arrow 17, this causes pivotal bar 48 to move from the position shown in FIG. 4 to that shown in FIG. 6 whereby drive shaft 42 is moved by thrust washer 40 to move bevel gear 50 in engagement with drive gear 54 which is rotated by the rotation of axle 56 by wheels 18. Rotation of drive shaft 42 rotates drive shaft 52 through the pin 58 and slot 57 arrangement shown in FIG. 7. This affords linear movement of shaft 42 in shaft 52 while maintaining connection of the two shafts. Rotation of shaft 52 effects a pumping action in pump 64.

As best seen in FIG. 8, floor finish flows through flexible feed conduit 25 into peristaltic pump 64. It is pumped into output flexible conduit 83 and into spray conduit 87 where it is dispensed through orifices 89. Activation of the peristaltic pump 64 during movement of the cart 12 can be prevented by the roller clutch 94 in conjunction with wheels 18. This is shown in FIG. 5. A roller bearing 92 is mounted on shaft 56 as is roller clutch 94. A spacer 93 separates bearing 92 and housing 16. In the event bail 69 is not moved to a position to place pivot bar 48 in the position shown in FIG. 4 with the non-engagement of gears 50 and 54, roller clutch prevents activation of pump 64 during movement of the cart 12.

An advantageous feature of some embodiments of the applicator is the disposable connector 79 and the disposable flexible conduits 25, 81, 83 and spray conduit 87. When the application of the floor finish in complete, these components can be readily removed and replaced without any cleaning of the peristaltic pump 64. In other words, through the use of a peristaltic pump, the floor finish never contacts the pump. As such, time consuming clean-up is not necessary. Rather, the conduit is simply removed from the pump and replaced prior to next operation.

Another advantage of some embodiments the application 10 is the dual use of mop 28. It acts as a spreader for the floor finish when attached to the cart 12, yet allows use separately as a hand operated mop in order to apply floor finish to areas of floors not readily accessible when attached to the applicator.

A roller clutch 94 has been described in conjunction with applicator 10. If desired this could be eliminated as deactivation of the pump 64 can be effected during a forward motion of the applicator by placing bail 69 in the upward position shown in solid lines in FIG. 2. Neither is it essential to have the mop 28 disengageable from the applicator 10. All such and other modifications within the spirit of the invention are meant to be within the scope as defined by the appended claims.

Thus, the invention provides, among other things, a floor finish applicator. Various features and advantages of the invention are set forth in the following claims.

What is claimed is:

1. A floor finish applicator comprising:

a cart having wheels and a body member constructed and arranged to receive a source of floor finish;

a mop having a handle and a mop head;

a clamp assembly coupled to the cart adjacent an end of the body member, the clamp assembly configured to releasably secure the mop handle in a fixed position and orientation with respect to the cart; and a cart handle disposed adjacent an opposite end of the body member;

wherein the mop handle is releasable with respect to the clamp assembly for movement of the mop to different positions relative to the clamp assembly.

2. The floor finish applicator of claim 1, wherein the clamp assembly includes a first clamp and a second clamp each receiving a different portion of the mop handle.

3. The floor finish applicator of claim 2, wherein the mop handle is secured at an angle relative to a floor surface.

4. The floor finish applicator of claim 2, wherein the first clamp is coupled to a first frame member of the cart and the second clamp is coupled to a second frame member of the cart such that the mop is spaced from the body of the cart.

5. The floor finish applicator of claim 2, wherein the first and second clamps are located at different heights with respect to one another and wherein the first clamp is located forwardly of the second clamp.

6. The floor finish applicator of claim 1, wherein the clamp assembly is configured to receive the mop handle in a snap-fit engagement.

7. The floor finish applicator of claim 1, wherein the cart is propelled such that the mop trails the body member to spread floor finish as the cart moves along a floor surface.

8. The floor finish applicator of claim 1, wherein the mop is configured to spread the floor finish when attached to the cart and when separated from the cart.

9. The floor finish applicator of claim 1 further comprising:

a peristaltic pump connected to the body member;

a conduit adapted to be connected to the source of floor finish and the pump; and a transmission assembly constructed and arranged to drive the pump by movement of the wheels.

10. A floor finish applicator comprising:

a wheeled cart including a body member having a first end and a second end, the body member constructed and arranged to receive a source of floor finish;

a mop having a handle and a mop head;

a clamp assembly disposed adjacent the first end to releasably secure the mop handle in at least one position with respect to the cart; and a cart handle disposed adjacent the second end, wherein the clamp assembly includes a first clamp and a second clamp vertically offset from the first clamp to couple the mop handle at an angle relative to a floor surface.

11. The floor finish applicator of claim 10, wherein the first and second clamps releasably secure the mop handle in a snap-fit engagement.

12. The floor finish applicator of claim 10, wherein the cart is propelled such that the mop trails the body member to spread floor finish as the cart moves along a floor surface.

13. The floor finish applicator of claim 10, wherein the mop is configured to spread the floor finish when attached to the cart and when separated from the cart.

14. The floor finish applicator of claim 13, wherein the cart is supported by a pivotable stand when in the second state.

15. The floor finish applicator of claim 10, wherein the mop handle and the cart handle extend in a substantially common direction.

16. A floor finish applicator comprising:

a wheeled cart including a body member constructed and arranged to receive a source of floor finish, the cart also including a cart handle;

a clamp assembly coupled to the cart;

a mop including a mop handle releasably secured in at least one position with respect to the cart by the clamp assembly, the cart handle and the mop handle extending in a substantially common direction when the mop is attached to the cart, wherein the cart is propelled such that the mop trails the body member to spread floor finish as the cart moves along a floor surface.

17. The floor finish applicator of claim 16, wherein the clamp assembly includes a first clamp and a second clamp vertically offset from the first clamp such that the mop handle is secured at an angle relative to a floor surface by a snap-fit engagement.

18. The floor finish applicator of claim 16, wherein the mop is configured to spread the floor finish when attached to the cart and when separated from the cart.

19. The floor finish applicator of claim 16, further comprising a peristaltic pump connected to the body member;

a conduit adapted to be connected to the source of floor finish and the pump; and a transmission assembly constructed and arranged to drive the pump by movement of the wheels.

* * * * *